United States Patent [19]

Albert et al.

[11] Patent Number: 5,017,109

[45] Date of Patent: May 21, 1991

[54] CYLINDER AND HOUSING ASSEMBLY FOR PNEUMATIC TOOL

[75] Inventors: Gregory P. Albert, Waverly, N.Y.; Kenneth J. Dubuque, Sheshequin, Pa.

[73] Assignee: Ingersoll-Rand Company, Woodcliff Lake, N.J.

[21] Appl. No.: 470,714

[22] Filed: Jan. 26, 1990

[51] Int. Cl.[5] ..... F01C 1/344; F01C 13/02; F01C 21/10

[52] U.S. Cl. ..... 418/152; 418/270; 92/171.1

[58] Field of Search ..... 418/152, 270; 415/904, 415/915; 92/169.4, 171.1

[56] References Cited

U.S. PATENT DOCUMENTS

| | | | |
|---|---|---|---|
| 3,190,183 | 6/1965 | Walker et al. | 418/270 |
| 3,485,179 | 12/1969 | Dawes | 418/152 |
| 3,827,834 | 8/1974 | Kakimoto | 418/270 |
| 4,515,513 | 5/1985 | Hayase et al. | 418/270 |
| 4,631,012 | 12/1986 | Eckman | 418/270 |
| 4,740,144 | 4/1988 | Biek | 418/270 |
| 4,962,787 | 10/1990 | Mayhew | 418/270 |

*Primary Examiner*—John J. Vrablik

*Attorney, Agent, or Firm*—Robert F. Palermo; Arthur N. Trausch; Walter C. Vliet

[57] ABSTRACT

A pneumatic tool has a one-piece metal tube forming an air motor cylinder and an associated air inlet plenum. Air passages are formed between an inner housing, molded in situ about the motor cylinder tube, and an outer housing separately molded. The inner and outer housings are both formed from a non-metal composite material which contributes to operator comfort by its light weight, thermal insulation, vibration damping, and noise suppressing properties. The tool may be assembled to provide forward exhaust, rearward exhaust, or combined forward and rearward exhaust.

8 Claims, 3 Drawing Sheets

CYLINDER AND HOUSING ASSEMBLY FOR PNEUMATIC TOOL

BACKGROUND OF THE INVENTION

The present invention relates to a motor cylinder and housing assembly for a pneumatic tool and in particular to a cylinder having integral housing components.

Typically, pneumatic tools include a cylinder member having a motor chamber surrounded by a cylindrical housing member. The motor chamber can be adapted to contain a vane rotor, a turbine rotor, or a reciprocating piston motor. Inlet and exhaust ports are typically provided on the end plates or the motor cylinder. The outer cylindrical housing is typically made of steel or aluminum and is machined so as to provide at least two fluid distributing channels leading from one end of the cylinder to the other. Additionally, the housing is machined to include bearing seats and valve openings. Thus one disadvantage of known tools is that the manufacture of the motor cylinder and housing components are complex and expensive.

Furthermore, access to the various components in the housing is difficult and complicates the assembly and maintenance of the tool.

SUMMARY OF THE INVENTION

It is therefore an object of the present invention to provide a motor cylinder and housing assembly having fewer parts than conventional assemblies.

It is another object of the present invention to provide a cylinder and housing construction having easy to manufacture components, easy assembly of the components, and easy disassembly and repair.

It is another object of the present invention to provide a motor cylinder and housing assembly which allows the use of nonmetallic housing materials while maintaining structural strength for industrial application.

It is a further object of the present invention to provide motor cylinder and housing assembly requiring minimal machining yet providing required close tolerances.

In one aspect of the present invention, the above objects are accomplished by providing a cylinder having a fluid motor chamber and fluid inlet and exhaust ports on the circumferential surface of the cylinder which are in fluid communication with the motor chamber. An inner housing, preferably of a composite material, is formed in situ on the cylinder. The inner housing has open fluid channels extending along the surface. An outer housing sleeve, also preferably of a composite material, is constructed and fitted to the inner housing to enclose the fluid channels so as to form sealed fluid passageways.

The main advantage of the present invention is the simplification of the manufacture and assembly of the component parts for the cylinder and housing assembly. The metal cylinder member, for example, can be die cast or machined from stock. Minimal close tolerance machining is required other than the motor cylinder chamber. The inner housing member can be in situ molded of a non-metallic composite material or can be a die cast metal. The outer housing can be a die cast metal or an injection molded composite material that is fixed in place over the inner housing member.

While simplified manufacturing, machining, and assembling procedures are the main advantages of the construction of the present invention, additional advantages are available when the component parts are constructed of non-metallic composite material rather than the traditional metal of convention tool housings. For composite housings, the vibration damping is increased, the thermal insulation minimizes the transfer of cold and hot spots to the operator, and the overall weight of the tool is reduced. This provides greater operator comfort.

The foregoing and other aspects of the present invention will become apparent from the following detailed description of the invention when considered in conjunction with the accompanying drawings. It is to be understood, however, that the figures are not intended as definition of the invention but are for purposes of illustration only. For example, while a vane rotor is shown in the preferred embodiment, a turbine rotor or a reciprocating piston motor could also be used as the motive element in the cylinder and housing assembly of the present invention.

DETAILED DESCRIPTION OF THE PREFERRED EMBODIMENT

Figure 1:
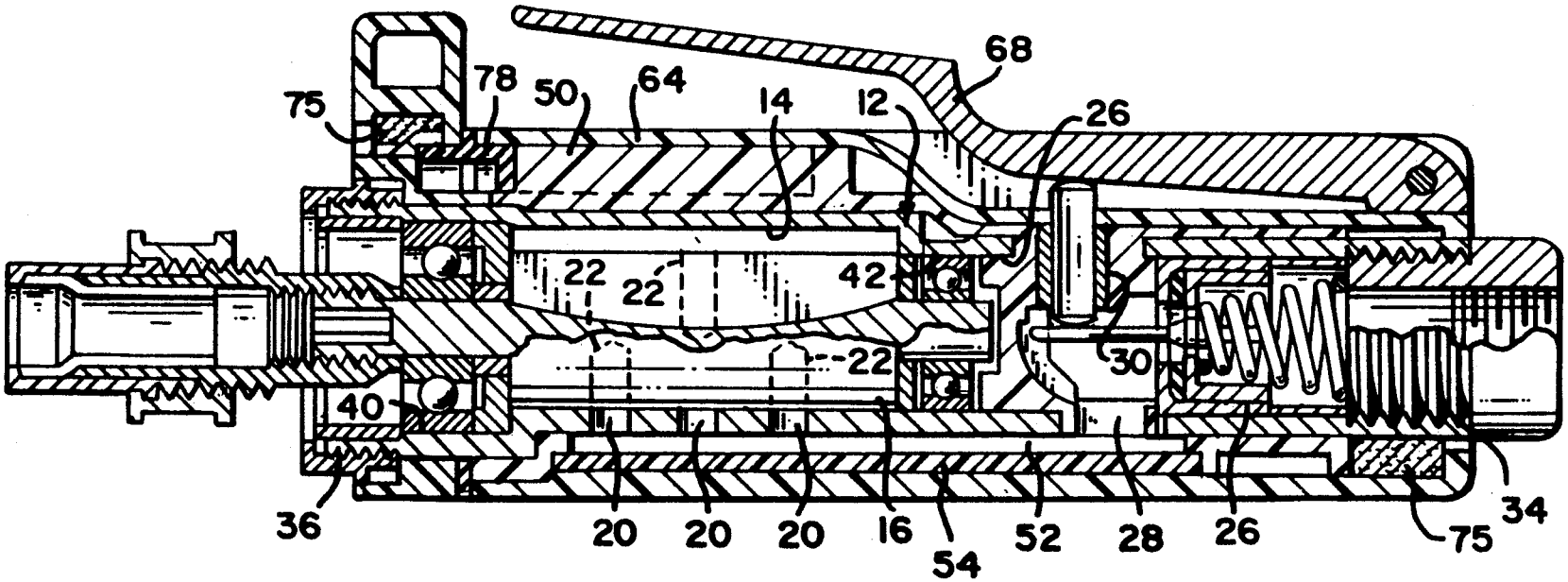
FIG. 1 is a cross sectional side view schematically illustrating the preferred embodiment of the motor cylinder and housing assembly of the present invention.
Figure 2:
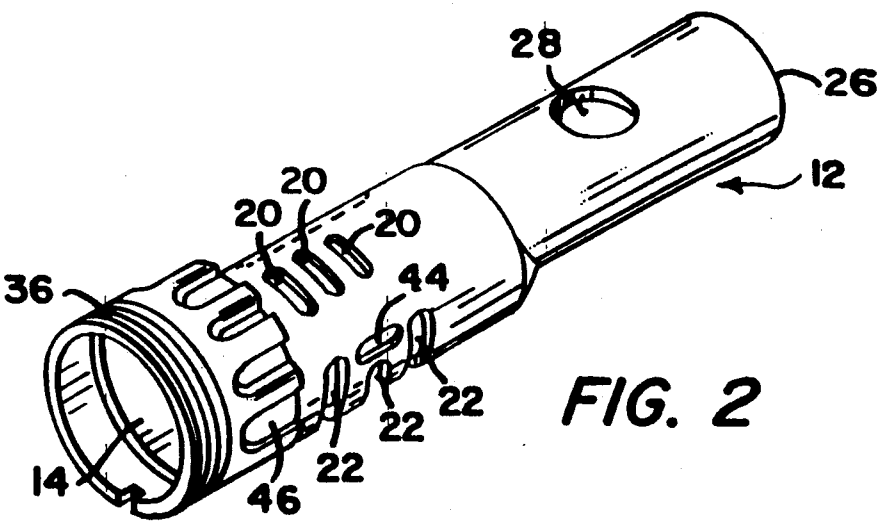
FIG. 2 is a perspective view of the motor cylinder.

In the illustrated example according to FIGS. 1 and 2, a pneumatic hand tool incorporating the present invention includes a tubular cylinder 12. A circular motor chamber 14 is axially disposed in one end. The cylinder is die cast metal or machined from stock. The motor chamber 14 disposed in one end of the cylinder is appropriately machined, heat treated, and ground to the proper tolerance.

The motor chamber 14 is adapted to contain a vane rotor 16 as shown in the preferred embodiment or alternatively could contain a turbine rotor or a reciprocating piston motor. For the preferred embodiment, the motor chamber is eccentrically offset from the centerline of the cylinder in the conventional vane motor configuration. Inlet ports 20 on the circumferential surface of the cylinder 12 are in fluid communication with the motor chamber 14. Three longitudinally aligned inlet ports are shown, for example.

Exhaust ports 22 are also positioned on the circumferential surface of the cylinder 12 and are in fluid communication with the motor chamber 14. The exhaust ports are located at an appropriate angular distance in the direction of rotor rotation around the circumferential surface from the inlet ports. The exhaust ports 22 can have a staggered configuration, as depicted, for more efficient motor operation.

At the opposite end of the cylinder from the motor chamber 14 is an axially oriented inlet plenum 26. The motor chamber 14 and the inlet plenum 26 are separate cavities inside opposite ends of the cylinder 12. A valve opening 28 allows fluid communication from the inlet plenum 26 to the exterior of the cylinder 12. Preferably, the valve opening 28 is longitudinally aligned with the inlet ports 20. A valve bushing hole 30 (FIG. 1) is provided into the inlet plenum approximately circumferentially opposite the valve opening 28.

Threaded connections are provided at each end of the cylinder 12 for retaining members. For example, in the preferred embodiment, an internal thread 34 is provided in the inlet plenum. An external thread 36 is depicted on the circumferential surface of the cylinder at the motor chamber end.

The preferred embodiment of the invention incorporates a vane motor such as that disclosed in U.S. Pat. No. 4,960,373, filed Mar. 17, 1989, issued Oct. 2, 1990, for a "Fluid Motor Rotor Assembly", by Greg Albert and assigned to Ingersoll-Rand Company. The motor chamber end also includes a front rotor bearing bore 40 and a rear rotor bearing bore 42 for bearings to support the rotation of the rotor.

Slots 44 (FIG. 2) are provided on the outer circumference surface of the cylinder 12 to assure positive rotational retention of the cylinder in the housing 50 which will be discussed next. Additionally, for example, notches such as 46 can be provided to insure a proper thickness of a molded material forming teeth 60 (FIGS. 3 and 5) for retaining additional parts at the front of the tool against relative rotation. Without notches 46, retaining teeth 60 would be only a thin layer of non-metallic composite material molded on the smooth metal surface of the cylinder 12. These would be inherently weak and would tend to break loose from the cylinder. When inner housing 50 is molded on cylinder 12, the composite material completely fills notches 46 and projects above the surface of the cylinder 12 to provide the teeth 60 shown in FIG. 5 which is an inverted view of the end of the assembly shown in FIG. 3.

An inner housing 50 (FIG. 3) is formed in situ on the cylinder 12. The inner housing is cast or molded such that radially inward extending stubs fill in the previously described notches 46 and slots 44 and thus assure positive retention of the inner housing against rotation on the cylinder. The inner housing is preferably molded of a non-metallic composite material but could also be cast from a metal.

Figure 3:
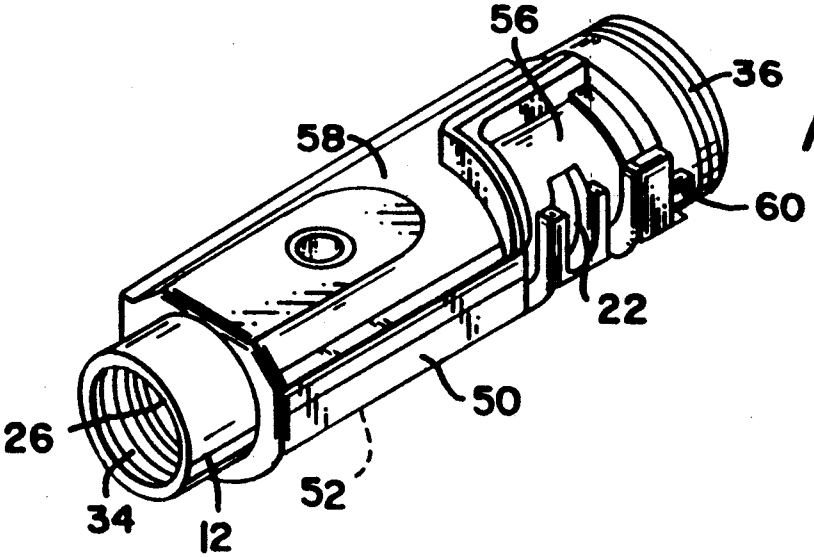
FIG. 3 is a perspective view of the motor cylinder and integrally molded inner housing.

As best seen in FIG. 3, open fluid channels are formed by the inner housing 50. An inlet channel 52 shown in FIG. 1, and generally indicated in FIG. 3 extends substantially longitudinally along the inner housing and connects the inlet ports 20 with the valve opening 28. An inlet channel plate 54 , also shown in FIG. 1, is optionally provided and may be sealingly fixed over the inlet channel 52 to form a sealed fluid inlet passageway. In cases where the outer housing sleeve 64 is not bonded to inner housing 50, it is preferred to employ inlet channel plate 54 bonded over inlet channel 52 to form a leak tight inlet fluid passageway.

A forward directed exhaust channel 56 is in fluid communication with the exhaust ports 22 and the forward end of the inner housing. A rearward directed exhaust channel 58 is circumferentially adjacent the forward exhaust channel. The rearward exhaust channel 58 extends from the front end of the inner housing longitudinally to the rear end of the housing and is brought into service by means of a fluid flow reversing and regulating ring 78, in FIG. 1, as disclosed by Mayhew in U.S. Pat. No. 4,962,787 filed Mar. 17, 1989, issued Oct. 16, 1990, and assigned to Ingersoll-Rand Company.

Figure 3A:
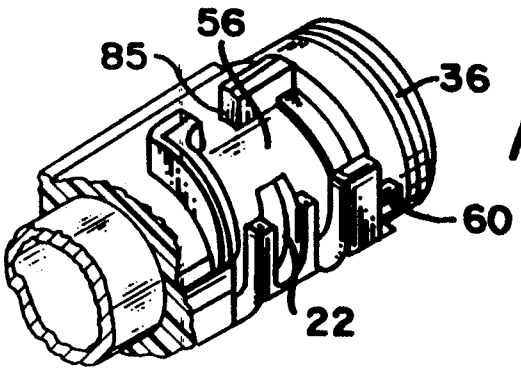
FIG. 3A is a fragmentary perspective view showing the slot provided for simultaneous forward and rearward exhaust.

In the preferred embodiment, one may choose either frontward or rearward exhaust. There may, however, be times when performance requirements will demand bi-directional exhaust in order to permit a sufficiently large air flow rate. In such cases, as shown in FIG. 3A, the rib between the forward exhaust channel 56 and rearward exhaust channel 58 may be formed with a communication slot 85 to permit such flow.

Near the forward and rearward exhaust outlets, seen in FIG. 1, are located fibrous porous silencer elements 75, also seen in FIG. 1, which help to reduce operating noise by their muffling action. These further increase operator comfort.

Figure 5:
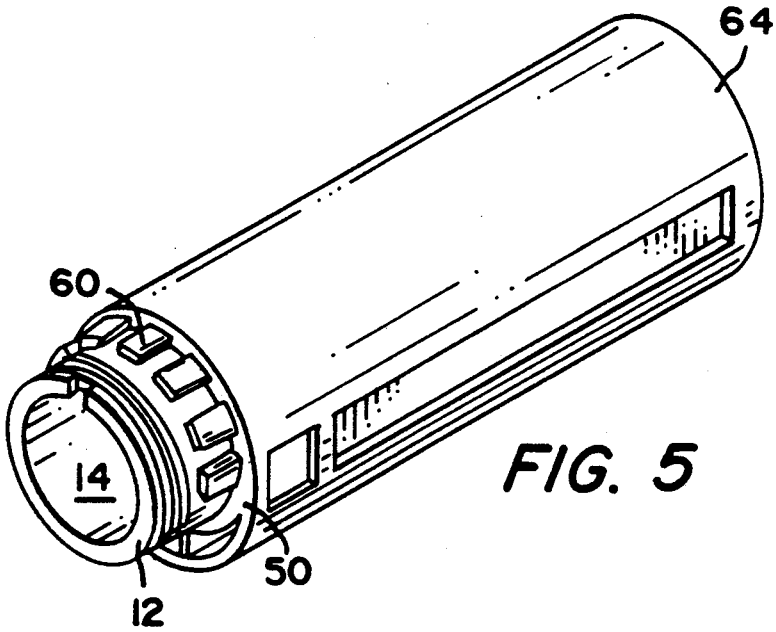
FIG. 5 is a perspective view of the assembly.

Referring now to FIGS. 2, 3, and 5, it can be seen that raised teeth members 60 (FIG. 5) are integrally formed on inner housing 50 radially outward from the notches 46 in the cylinder 12. These raised teeth assist in circumferentially locating and locking additional components on the housing assembly.

Figure 4:
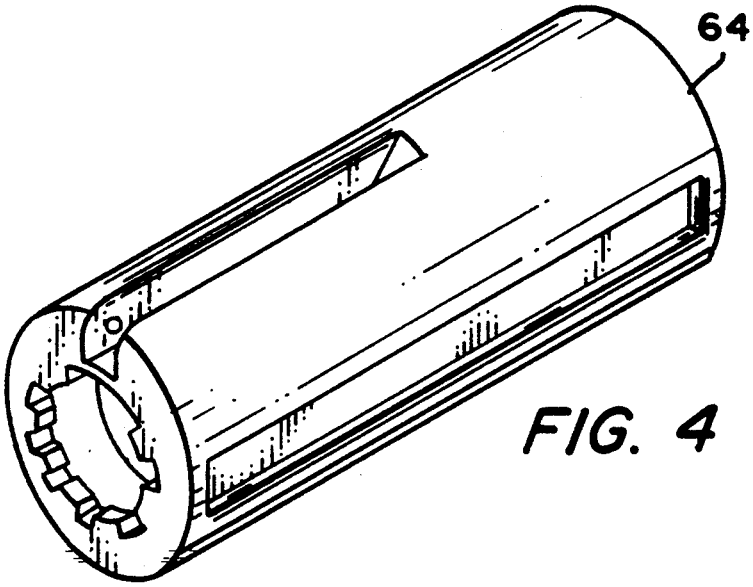
FIG. 4 is a perspective view of the outer housing sleeve.

An outer housing sleeve 64 (FIG. 4) is separately manufactured of preferably a non-metallic composite material. The sleeve is substantially a hollow cylinder having an inner diameter having a tight fit onto the inner housing member 50 so that, when bonded in place, it provides sealing covers for the fluid passageways defined by channels on the outer surface of inner housing 50. When the outer sleeve 64 is in its final position, the inner diameter circumferential surface encloses the forward exhaust fluid channel 56 and rearward exhaust fluid channel 58 so as to form forward and rearward exhaust passageways, which may be used singly or in combination as determined by tool performance requirements.

As previously described, an inlet channel plate 54 may be fixed over the inlet channel 52 to form a sealed inlet passageway. Alternatively, the inner circumferential surface of the outer sleeve 64 can be bonded to inner housing 50 and, thus, can form the outer top to the inlet channel so as to form a sealed inlet passageway.

From the description above, the preferred embodiment of the cylinder and housing assembly 10 according to the present invention includes three major components. Preferably the cylinder 12 is metal. The cylinder can be cast and machined to shape. Preferably the inner housing 50 is composite material that is molded in situ to the side walls of the cylinder 12. A subcomponent of the inner housing may be a separate inlet channel plate 54. The third major component is the outer housing sleeve 64 which is also preferably of a composite material. It should be noted, however, that both the inner housing 50 and outer housing sleeve 64 could also be made of die cast metal rather than non-metallic composite material.

The completed assembly for a pneumatic tool operates as follows. A pressurized fluid such as compressed air is provided to the inlet plenum 26 in a conventional manner. Operation of a throttle valve lever shown schematically at 68 allows the compressed air to flow through the throttle valve, through valve opening 28, and into the sealed inlet passageway 52. The compressed air then enters the motor chamber through the inlet ports 20. The compressed fluid acts on the motive member in the motor chamber. Both a turbine rotor and a reciprocating piston motor are considered within the scope of this invention. However, as previously stated, a multivane, positive displacement vane motor is the preferred embodiment.

The spent motive fluid is then exhausted through exhaust ports 22. From the exhaust ports the spent motive fluid enters the primary exhaust cavities 56 formed between the inner housing and the outer housing sleeve 64. At this point the fluid can be exhausted forward through the tool or can be redirected rearward along rearward exhaust channel 58, depending upon the installed position of the fluid flow reversing and regulating ring 78, already described and shown in FIG. 1. When market requirements demand, a degree of cross flow may be provided, by forming a slot 85 in the rib between the forward and rearward exhaust channels as shown in FIG. 3A so that exhaust fluid flows through both passageways, in order to permit a sufficient air flow rate.

While this invention has been illustrated and described in accordance with a preferred embodiment related to a handheld pneumatic tool, it is recognized that variations and changes may be made therein without departing from the invention as set forth in the following claims.

We claim:

1. A fluid operated mechanism comprising:

a cylinder having a fluid motor chamber and fluid inlet and exhaust ports on the circumferential surface of the cylinder in fluid communication with the motor chamber;

an inner housing formed in situ on the cylinder and having circumferentially adjacent fluid channels communicating with said inlet and exhaust ports extending axially along the surface of the inner housing thereby defining a fluid inlet channel and two mutually oppositely directed fluid exhaust channels; and an outer housing sleeve surrounding the inner housing and fixed to the inner housing to seal the edges of the fluid channels so as to form fluid passageways, said sleeve having an opening at each axial end to permit flow of exhaust from one of said oppositely directed fluid exhaust channels.

2. The mechanism of claim 1 wherein said cylinder includes a fluid inlet plenum having a valve opening in fluid communication with the inlet fluid channel of the inner housing, said plenum lying within an axial extension of the cylinder containing said fluid motor chamber.

3. The mechanism of claim 1, further comprising:

means for reversing and regulating exhaust flow to limit mass flow rate and to direct exhaust flow to a forward opening or a rearward opening of the outer housing sleeve.

4. The mechanism of claim 1, wherein exhaust fluid flow is directed to both the forward and rearward openings of the outer housing sleeve.

5. The mechanism of claim 1, wherein the cylinder is made from a metal alloy and the inner housing and outer housing sleeve are made from a non-metallic composite material.

6. A pneumatic tool comprising:

a metal cylinder having a fluid motor chamber and fluid inlet and exhaust ports on the circumferential surface of the metal cylinder in fluid communication with the motor chamber;

a non-metallic composite material inner housing molded in situ to the cylinder and having circumferentially adjacent fluid channels communicating with said inlet and exhaust ports extending axially along the surface of the inner housing thereby defining a fluid inlet channel and two mutually oppositely directed fluid exhaust channels; and a non-metallic composite outer housing sleeve surrounding the inner housing and bonded to the inner housing to seal the edges of the fluid channels so as to form fluid passageways, said sleeve having an opening at each axial end to permit flow of exhaust from one of said oppositely directed fluid exhaust channels.

7. The tool of claim 6 wherein said cylinder includes a fluid inlet plenum having a valve opening in fluid communication with the inlet fluid channel of the inner housing, said plenum lying within an axial extension of the cylinder containing said fluid motor chamber.

8. A fluid operated mechanism comprising:

a metal cylinder having a fluid motor chamber and a fluid inlet plenum axially aligned and adjacent thereto;

fluid inlet and exhaust ports radially communicating with the motor chamber through a wall of the cylinder;

an inner non-metallic housing formed in situ on the outer surface of the cylinder and having circumferentially adjacent fluid channels communicating with said inlet and exhaust ports extending axially along the surface of the inner housing thereby defining a fluid inlet channel, a forward flow fluid exhaust channel, and a rearward flow fluid exhaust channel;

an outer housing sleeve having an opening at a forward axial end and at a rearward axial end, said sleeve surrounding the inner housing and bonded thereto to seal the edges of the channels to form fluid passageways; and means for controlling the direction of exhaust flow.

* * * * *